US007787185B2

(12) United States Patent
Remaud et al.

(10) Patent No.: US 7,787,185 B2
(45) Date of Patent: Aug. 31, 2010

(54) BRICK OR BLOCK-SHAPED BUILDING ELEMENT AND THE ASSEMBLY THEREOF

(76) Inventors: Frederic Remaud, 36, rue Jemmapes, F-59000 Lille (FR); Frederic Gervais, 26, rue Pelleport, F-75020 Paris (FR)

( * ) Notice: Subject to any disclaimer, the term of this patent is extended or adjusted under 35 U.S.C. 154(b) by 206 days.

(21) Appl. No.: 11/886,627

(22) PCT Filed: Apr. 3, 2006

(86) PCT No.: PCT/FR2006/000727

§ 371 (c)(1),
(2), (4) Date: Nov. 2, 2007

(87) PCT Pub. No.: WO2006/106218

PCT Pub. Date: Oct. 12, 2006

(65) Prior Publication Data

US 2009/0183454 A1 Jul. 23, 2009

(30) Foreign Application Priority Data

Apr. 7, 2005 (FR) ..... 05 03473

(51) Int. Cl.
*G02B 17/00* (2006.01)

(52) U.S. Cl. ..... 359/591; 359/448; 52/306

(58) Field of Classification Search ..... 359/400, 359/591, 448, 592; 52/133, 306
See application file for complete search history.

(56) References Cited

U.S. PATENT DOCUMENTS

| | | | | |
|---|---|---|---|---|
| 1,991,469 | A | 2/1935 | Slayter | |
| 3,085,473 | A * | 4/1963 | Bourgeaux et al. | 359/623 |
| 3,490,421 | A * | 1/1970 | Pincus | 122/235.11 |
| 4,726,670 | A * | 2/1988 | Sherrard | 359/400 |
| 5,160,566 | A * | 11/1992 | Ashby et al. | 156/252 |
| 5,786,935 | A * | 7/1998 | Kanai et al. | 359/504 |

FOREIGN PATENT DOCUMENTS

| | | |
|---|---|---|
| EP | 0 133 989 A2 | 3/1985 |
| GB | 794864 | 5/1958 |

* cited by examiner

*Primary Examiner*—Christopher E Mahoney
*Assistant Examiner*—Leon W Rhodes
(74) *Attorney, Agent, or Firm*—Young & Thompson

(57) ABSTRACT

A building element (E) is used for building walls, partitions, plates or closing devices such as blinds and doors, in particular for buildings and includes at least one volume (3) in particular in the form of a prism or cylinder limited by first (1) and second (2) faces made of a transparent material and sidewalls (4), wherein the element (E) includes at least one lens (5) which contains a focal plane and is placed near the first face (1) and a translucent screen (7) placed between the lens (5) and the second face (2). The image of a space in front of the lens (5) is formed on the screen 7 and can be seen from the rear of the building element (E).

19 Claims, 8 Drawing Sheets

BRICK OR BLOCK-SHAPED BUILDING ELEMENT AND THE ASSEMBLY THEREOF

BACKGROUND OF THE INVENTION

1. Field of the Invention

The present invention relates to a brick or block-shaped building element for use in the construction of walls, partitions, paving, and closing devices such as shutters or doors, for buildings for example, comprising at least one body, particularly prismatic or cylindrical, limited by first and second parallel faces and side walls.

The invention is particularly applicable to architectural design.

2. Description of the Related Art

To provide fittings for external openings, architects and designers of architectural groupings have hitherto had to choose between solutions which enable inhabitants to have a wide view of the outside but do not preserve the privacy of the accommodation, and solutions which allow the passage of light and the maintenance of a degree of privacy, without enabling the inhabitants to view the outside.

Devices such as glass bricks allow light to pass into buildings, but do not allow a view of the outside, or only allow a very vague or blurred view. When transparent devices are used, it is impossible to view the outside without being seen.

Inventors have mainly concentrated on attempts to improve the thermal properties, to the detriment of the optical properties.

EP 0 133 989 describes a device using a light beam concentration chamber, in an attempt to use natural light from the outside while controlling heat exchanges. However, the described device does not enable persons inside a building to view the outside.

SUMMARY OF THE INVENTION

The object of the invention is primarily to provide a device which enables a person to have a clear image of the outside without being seen, and enables light to be brought into the building.

According to the invention, a building element for use in the construction of walls, partitions, paving, or closing devices such as shutters or doors, for buildings for example, comprises at least one body, particularly a parallelepipedal, prismatic or cylindrical body, limited by first and second parallel faces of transparent material and side walls, and is characterized in that it comprises at least one optical system, having a focal plane, placed in the vicinity of the first face, and a translucent screen positioned in such a way that the image of the space located in front of the lens is formed on said screen and can be observed from the rear of said building element.

The screen can be located between the optical system and the second face, or can be placed on the second face.

The second face can be transparent and its outer surface can be ground.

The screen can be located in the vicinity of the focal plane of the optical system. The optical system can have at least one lens which can be convex.

The side walls can have an opaque inner surface, at least in the space lying between the screen and the second face. In a variant, the side walls can be transparent, and can have an opaque outer surface, at least in the space lying between the screen and the second face.

The body of the element can be hollow or solid.

The optical system can occupy the whole of the first face. The first face and the optical system can be made in a single piece. The first face can comprise a plurality of lenses, each causing the formation of an image on the screen.

The body can have a geometric axis and the optical system can have an optical axis parallel to or coinciding with the geometric axis of the body, the screen being perpendicular to the optical axis of the optical system.

The screen can comprise a translucent plate.

The building element can have an intermediate space between the screen and the second face.

The building element can be molded in two parts, one comprising the first face and the optical system and the other part comprising the second face, the two parts being assembled one on each side of a plate acting as a screen.

The invention also relates to an assembly having a plurality of building elements identical to or different from those defined above.

The assembly can be produced by superimposing a plurality of layers containing the different parts of the building elements.

Other characteristics and advantages of the invention will be made clear in the following description, which refers to the attached drawings but is not limiting.

BRIEF DESCRIPTION OF THE DRAWING FIGURES

DETAILED DESCRIPTION OF THE INVENTION

Figure 1:
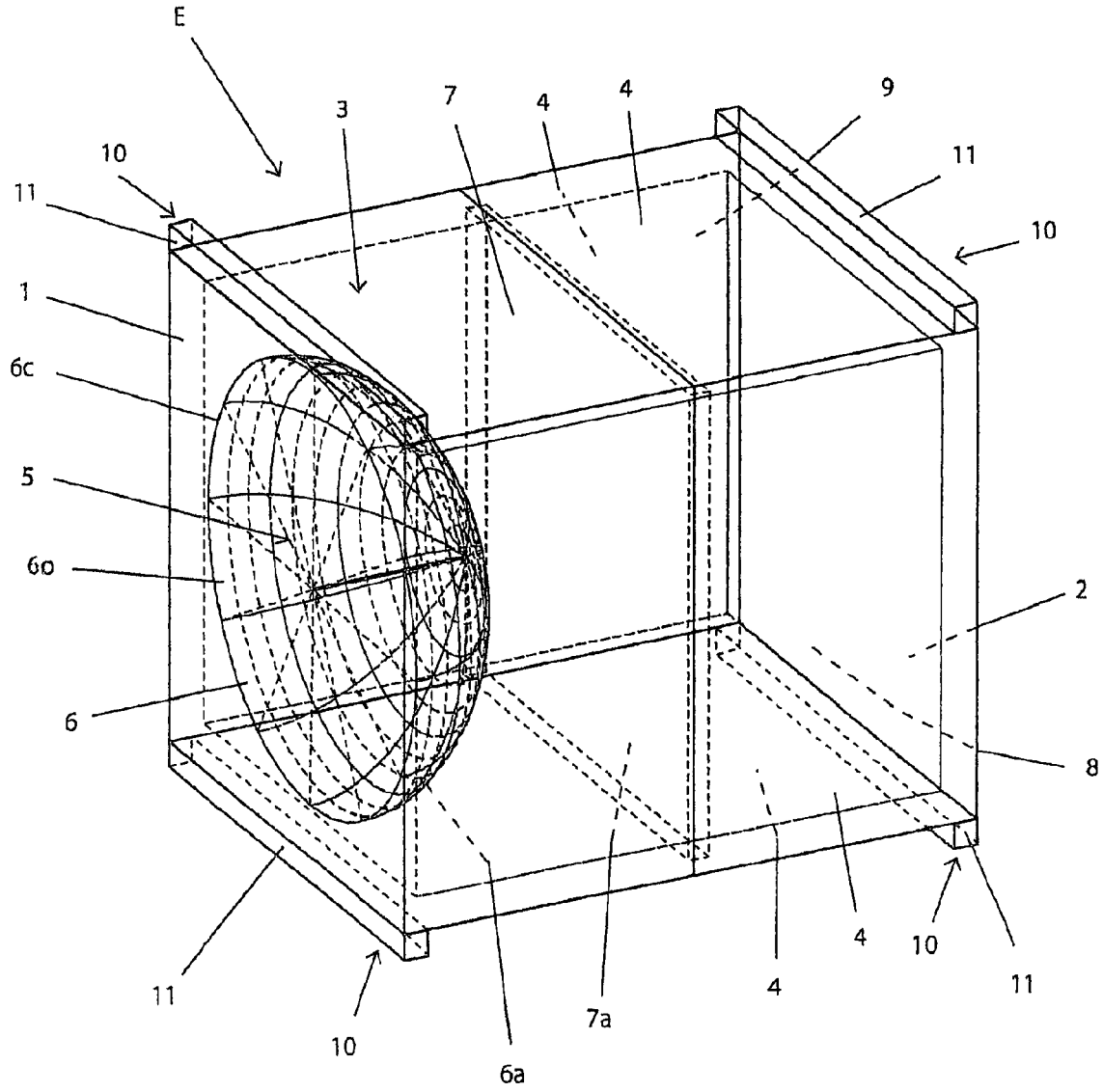
FIG. 1 is a perspective view of a building element according to the invention.
Figure 2:
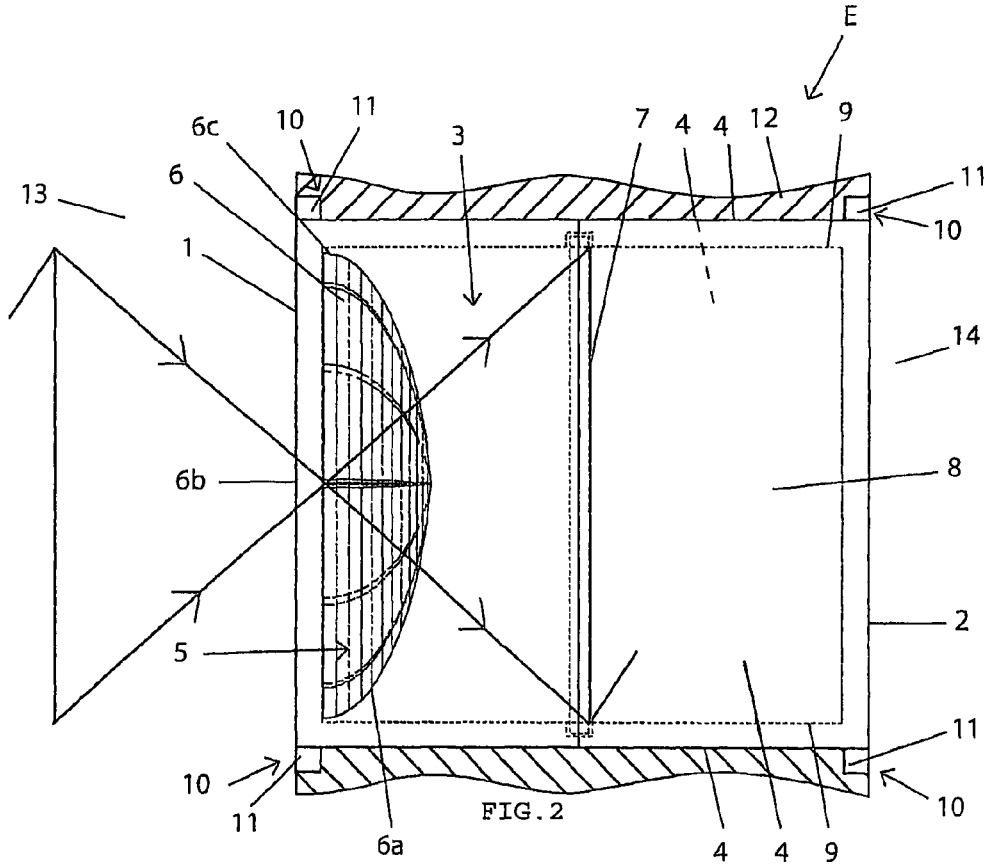
FIG. 2 is a view in side elevation, with parts truncated, of the element of FIG. 1, using a planoconvex lens, the convex part being inside the element.

With reference to FIGS. 1 and 2, it can be seen that a building element E according to the invention comprises a prismatic body 3 limited by first and second parallel faces 1 and 2 made from transparent material and side walls 4. The faces 1 and 2 are orthogonal to the generatrices of the flat walls 4. The body 3 is made entirely from glass or from transparent polymer material. Different materials, for example composite materials, can be used to form the side walls.

The body 3 is hollow and its cross section on a plane parallel to the first face 1 is a polygon, for example a square.

An optical system 5 composed of a planoconvex lens 6 is positioned on the first face. The surface 6*a* of the lens 6 facing the inside of the element E is convex, while the surface 6*b* of the lens 6 facing the outside of the element E is flat. The profile 6*c* of the lens 6 is preferably tangential to the inner surface of the side walls 4 or to its continuation, so as to maximize the size of the lens and consequently the quantity of light penetrating into the element E. It is possible to provide a lens 6 with a profile 6*c* truncated in such a way that the lens 6 can occupy the whole surface of the first face 1.

The lens 6 is produced directly from the first face 1 during the molding.

A translucent plate forming a screen 7 is positioned inside the body 3 in the focal plane of the lens 6, or in the vicinity thereof. The screen 7 can be produced from a transparent material such as glass, whose face 7*a* orientated towards the lens 6 is ground. The screen 7 is positioned between the lens 6 and the second face 2 in such a way that an image of the space located before the lens 6 is formed on the screen 7. This arrangement makes it possible to obtain a clear image of an object located at infinity, but the device can be focused differently, with a focus on close objects for example, by placing the screen 7 in the image plane of the object plane.

The body 3 has a geometric axis and the optical system 5 has an optical axis parallel to or coinciding with the geometric axis of the body 3. The screen 7 is perpendicular to the optical axis.

The element E has an intermediate space 8 between the screen 7 and the second face 2, in order to prevent as many as possible of the parasitic light beams originating inside the building from striking the ground surface of the screen 7 and interfering with the reading of the image.

The side walls 4 have an opaque coating 9 in the intermediate space 8. The opaque coating 9 is applied to the inner surface of the intermediate space 8. In a variant, the side walls can be transparent and the opaque coating can be applied to the outer surface of the intermediate space 8, thus simplifying the manufacturing process.

The element E has securing means 10 for fixing the element E to, for example, a wall or other elements according to the invention. These securing means 10 are composed of projecting parts 11 which, for example, enable the effectiveness of the seal to be improved.

The element E is produced by molding. It is advantageous to mold the element E in two parts, one comprising the first face 1 and the optical system 5 and the other part comprising the intermediate space 8 and the second face 2. The two parts are assembled one on each side of the plate acting as a screen 7. Thus the two parts of the mold are of a simple design, and problems of removal from the mold can be avoided.

When the element E is in position in an opaque wall 12, on its own or with other similar elements, the first face 1 being located on the outer side 13 of the wall 12 and the second face 2 being located on the inner side 14, the light beams from the outside penetrate into the element E through the first face 1, passing through the optical system 5, in other words the lens 6. They then converge on the focal plane of the lens 6 and form an image on the screen 7, located in the vicinity of the focal plane of the lens 6. The resulting image is clear and can be seen, through the second face 2, by an observer located on the inner side of the wall 12.

This operation is not reversible, and an observer located on the outer side 13, looking through the first face 1, will not see any image on the screen 7. Moreover, the screen 7 will appear to him to be more or less illuminated according to the variations of luminous intensity on the inner side 14.

Numerous variations are possible, based on the embodiment described above.

Figure 3:
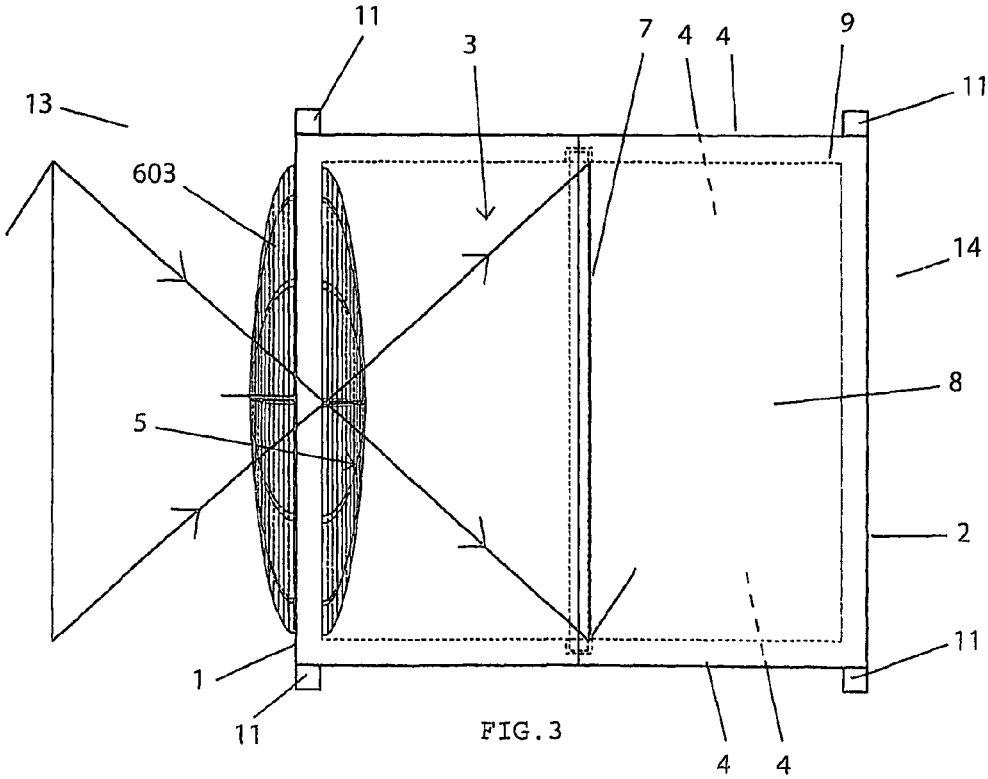
FIG. 3 is a view identical to FIG. 2, in which the element uses a biconvex lens.

In particular, it is possible to use different types of lenses. By using a biconvex lens 603 (FIG. 3), the focal distance, and consequently the overall dimensions of the element E, can be decreased.

Figure 4:
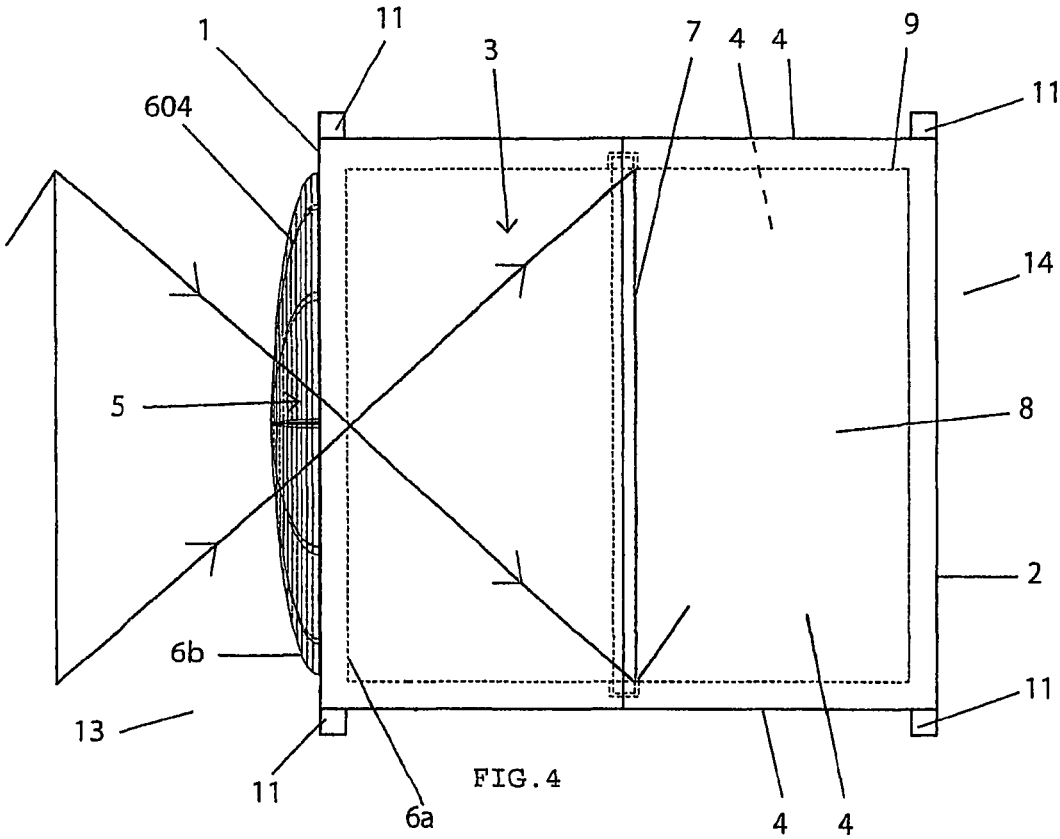
FIG. 4 is a view identical to FIG. 2, in which the convex part is outside the element.

By using a planoconvex lens 604 having a flat surface 6*a* and a convex surface 6*b* (FIG. 4), the geometrical aberrations can be decreased with respect to the embodiment of FIG. 2.

Figure 5:
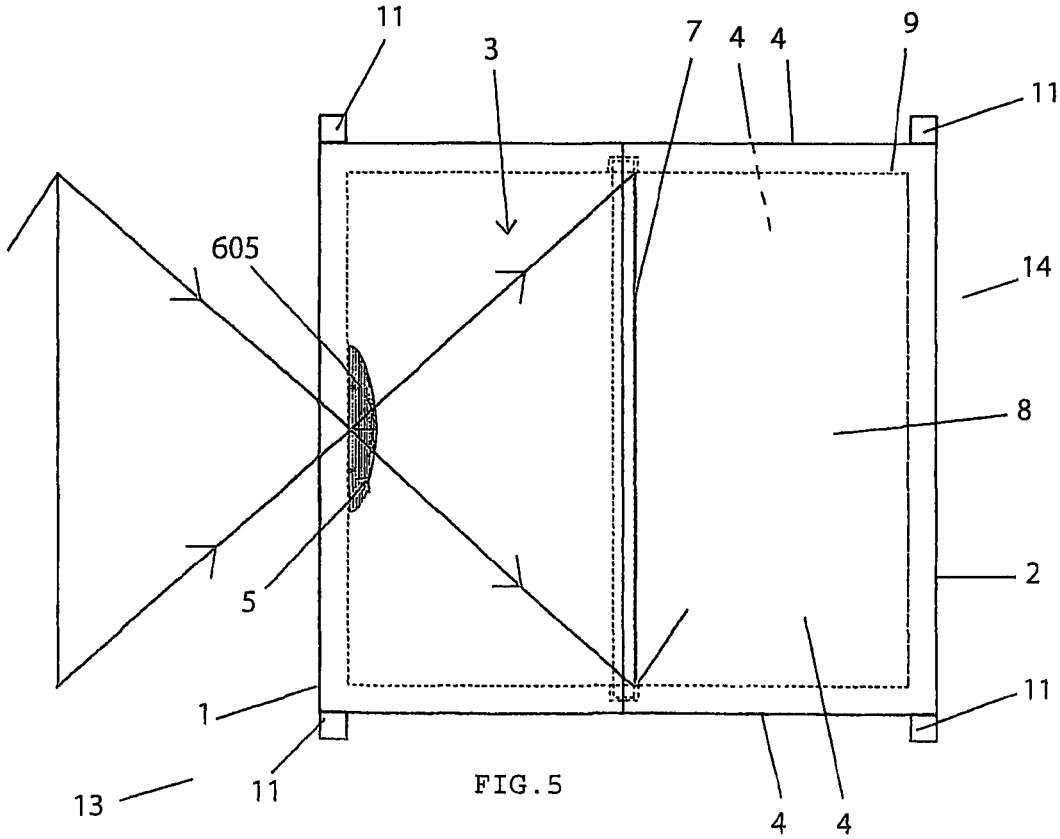
FIG. 5 is a view identical to FIG. 2, in which the element uses a lens which only partially covers the surface of the first face.

FIG. 5 shows another embodiment of an element according to the invention, in which a small-diameter lens 605, occupying only part of the face 1, is used, thus decreasing the amount of light reaching the screen.

Figure 6:
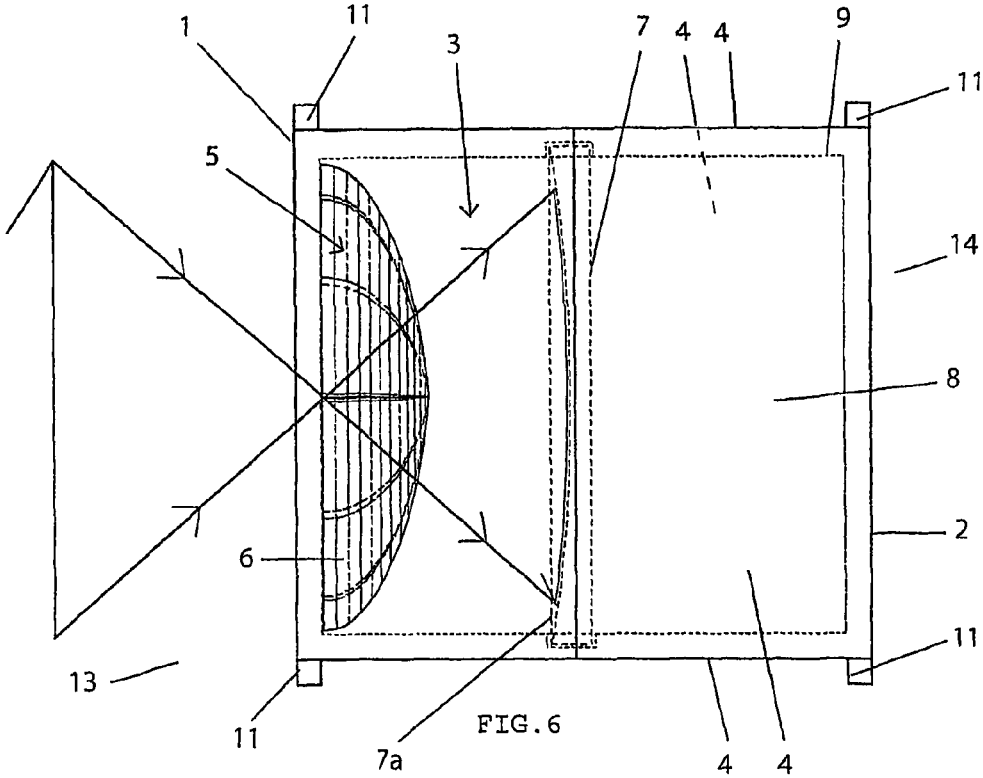
FIG. 6 is a view identical to FIG. 2, in which the element uses a hemispherical screen.

FIG. 6 shows another embodiment of an element according to the invention, in which the surface 7*a* of the screen 7 has a hemispherical profile. This type of profile makes it possible to correct, at least partially, deformations due to the lens which are observed at the periphery of the image.

Figure 7:
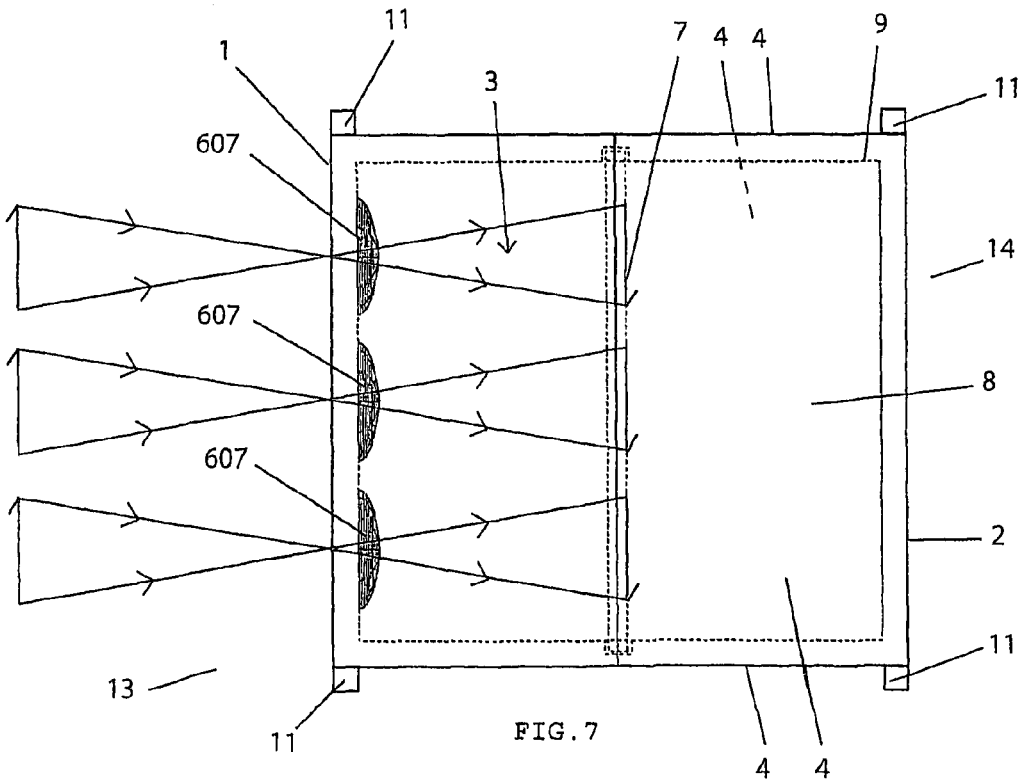
FIG. 7 is a view identical to FIG. 2, in which the element uses a plurality of lenses.

The optical system 5 can have a plurality of lenses. FIG. 7 shows a plurality of lenses 607 positioned on the face 1, making it possible to obtain a plurality of images on the screen 7, each lens causing the formation of a corresponding image. It is also feasible to interpose one or more lenses or similar devices between the lens 6 and the screen 7, along the optical axis of the optical system 5. Such additions can be made, in particular, in order to improve the quality of the image obtained on the screen 7 or to achieve esthetic effects.

Figure 8:
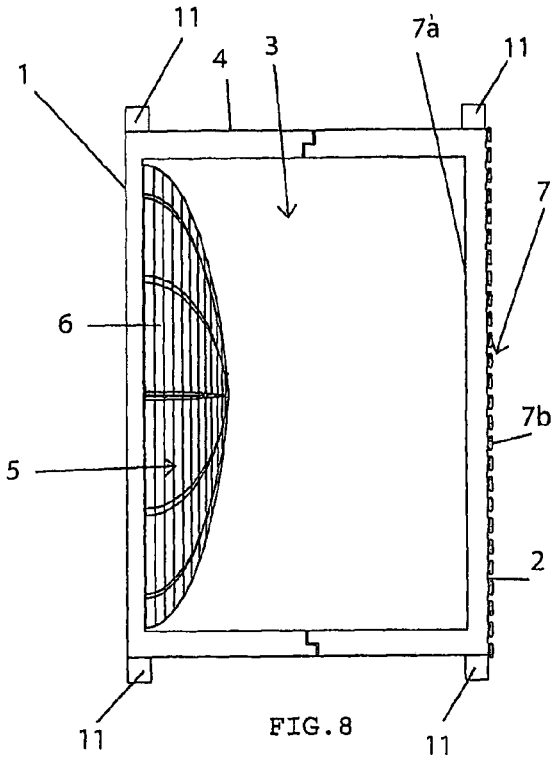
FIG. 8 is a view identical to FIG. 2, in which the screen coincides with the outer part of the second face.
Figure 9:
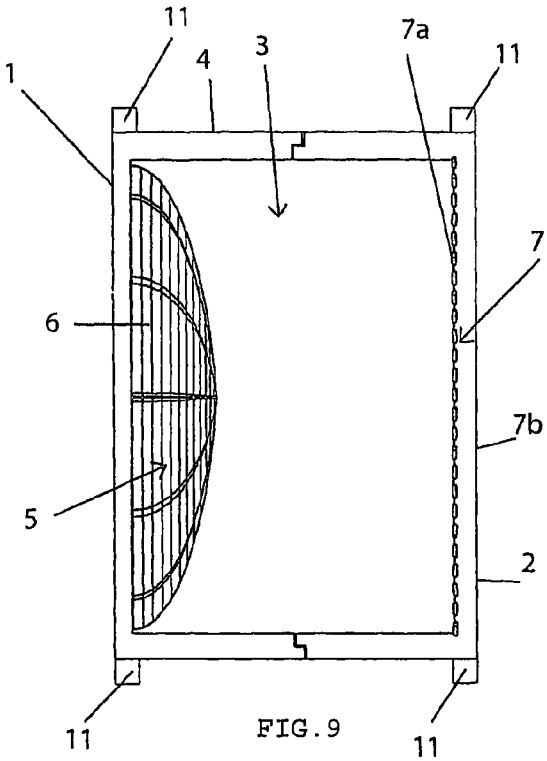
FIG. 9 is a view identical to FIG. 2, in which the screen coincides with the inner wall of the second face.
Figure 10:
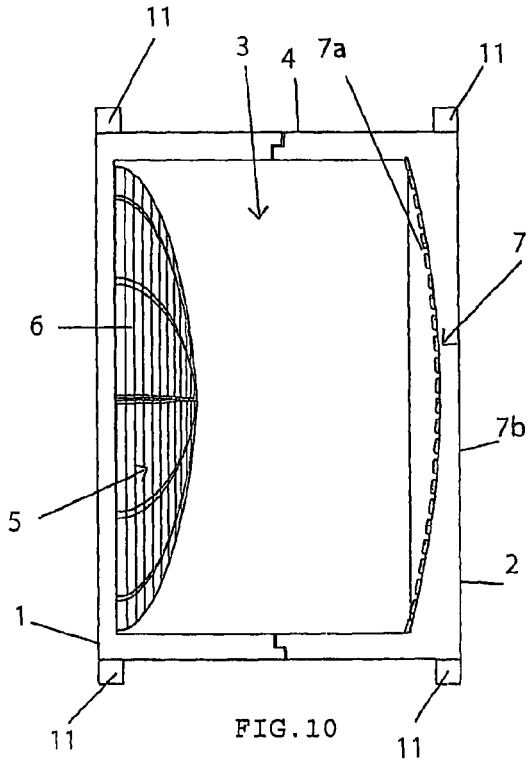
FIG. 10 is a view similar to FIG. 9, in which the screen is hemispherical.

In another embodiment shown in FIGS. 8 to 10, the element according to the invention has no intermediate space 8. In this case, the screen is positioned on the second face 2. The second face 2 is transparent and its outer surface is ground as in FIG. 8, or alternatively the screen 7 is formed on the inner surface of the second face 2 as shown in FIG. 9.

This type of arrangement is easier to produce, particularly in the case in which the element E is solid. The outer surface of the second face 2 is then ground to form the screen 7.

Clearly, this embodiment can be combined with elements mentioned previously, and, in particular, FIG. 10 shows a case in which the element according to the invention does not have an intermediate space 8 and is formed with the face 7*a* of the hemispherical screen 7.

This type of embodiment is to be used ideally in situations in which the exterior light is stronger than the interior light.

Figure 11:
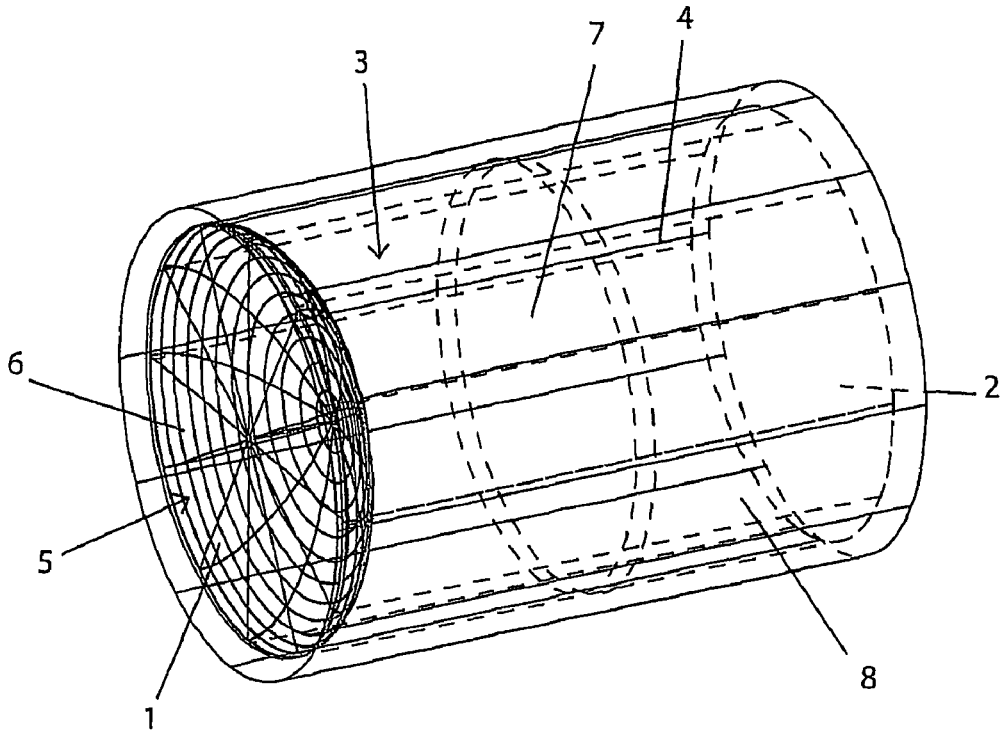
FIG. 11 is a perspective view of a second embodiment of an element according to the invention, in which the element is of cylindrical shape.
Figure 12:
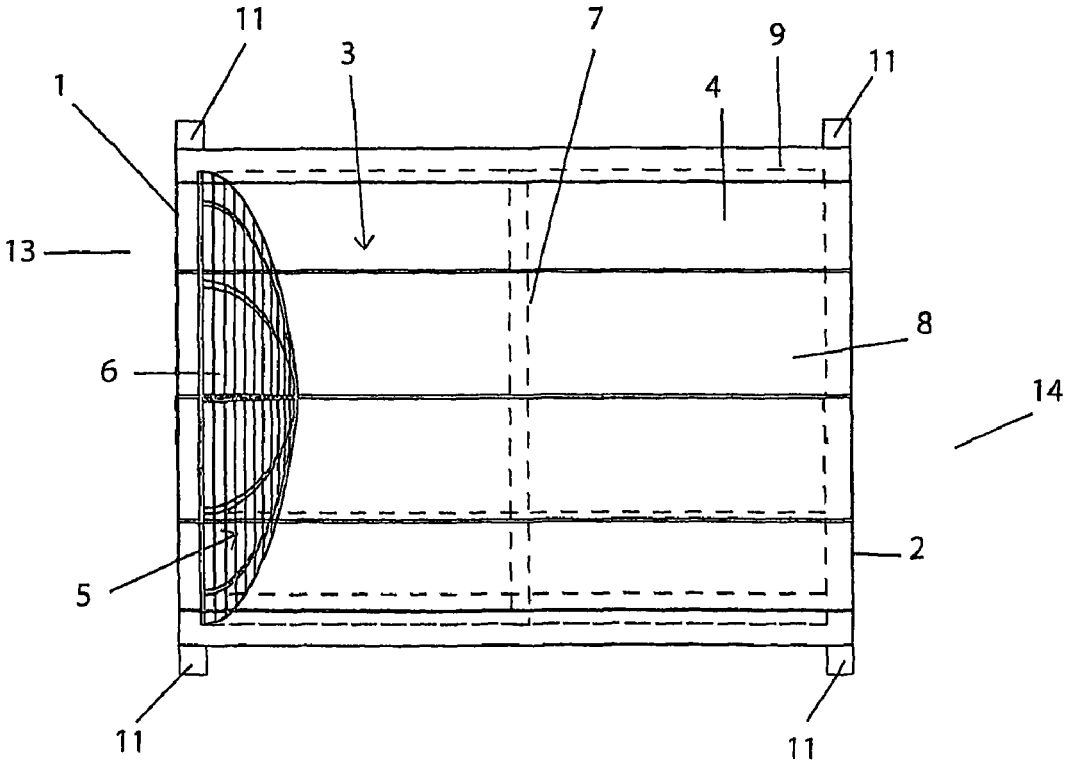
FIG. 12 is a view in side elevation of the element of FIG. 11.

The element is commonly made in a prismatic shape, but other shapes are feasible. FIGS. 11 and 12 show an embodiment in which the element is of cylindrical shape.

Figure 13:
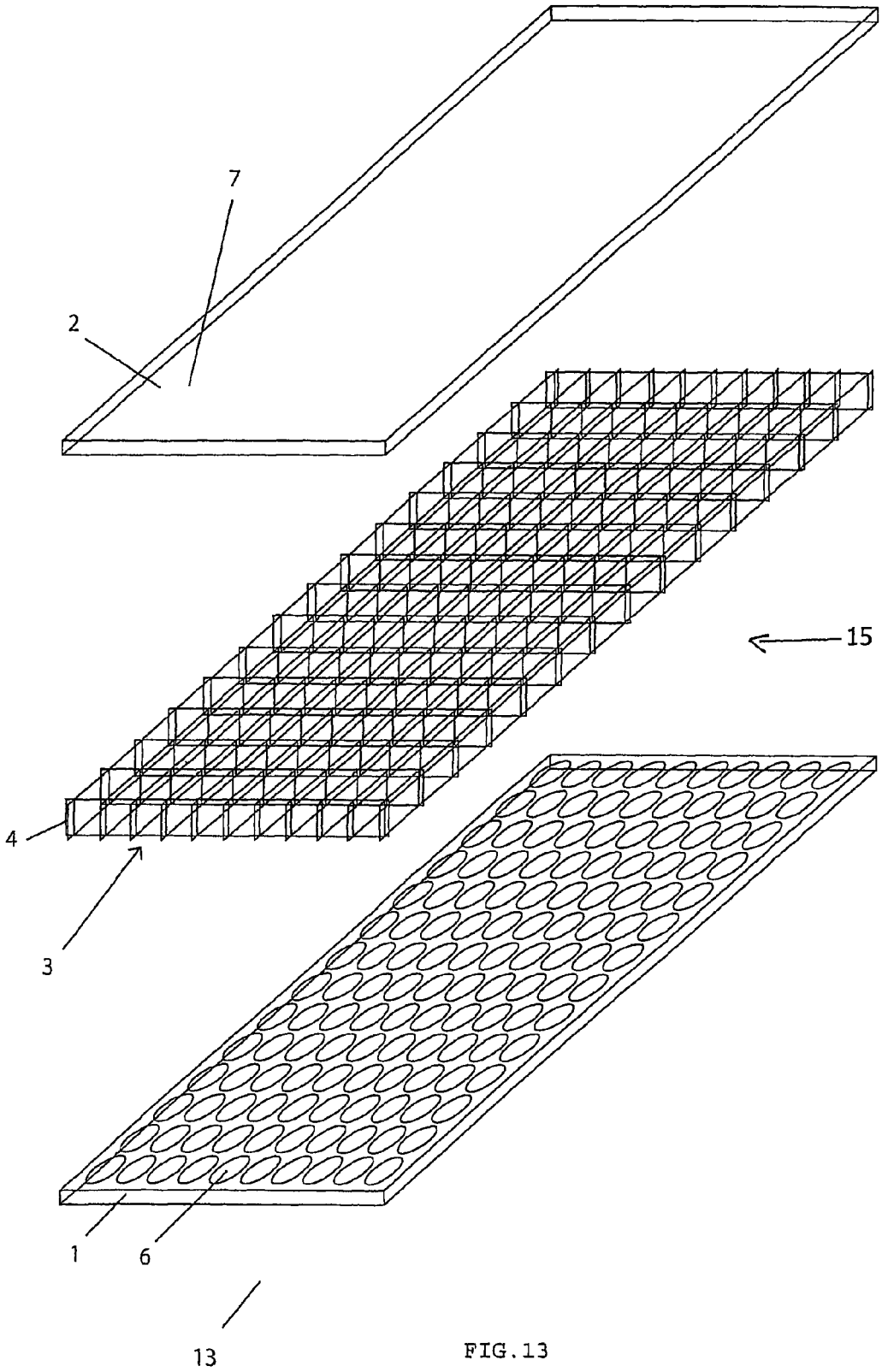
FIG. 13 is a perspective view of an assembly of elements according to the invention in the form of a panel.
Figure 14:
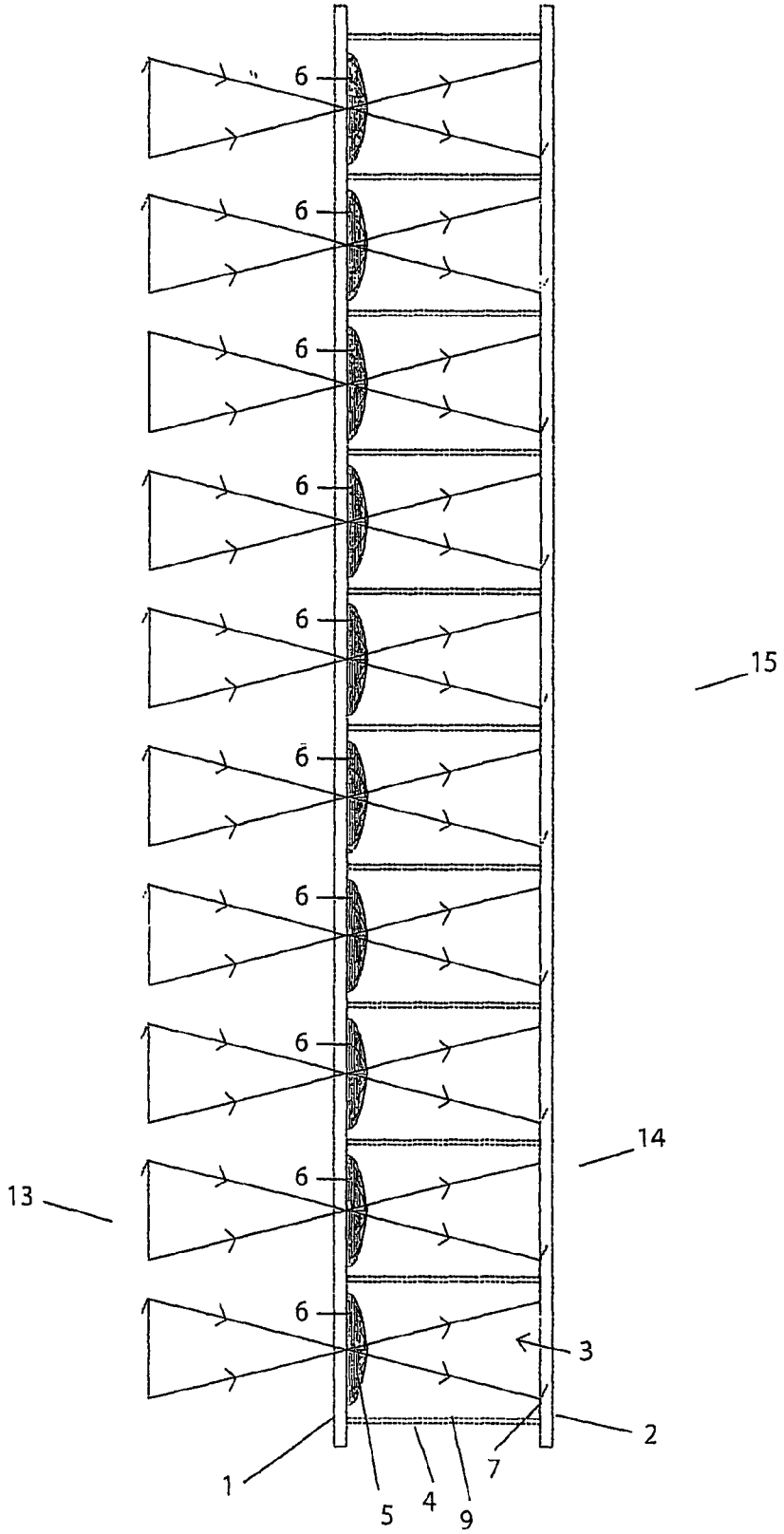
FIG. 14 is a view in side elevation of the assembly of FIG. 14.

A plurality of elements E can be combined in order to cover a larger surface. In this way, the transmission of light into the building becomes greater and true panels 15 or partitions can be created (FIGS. 13 and 14).

These sets of elements can be produced in the form of composite panels having multiple layers. For example, a first layer contains the first faces 1 and the optical systems 5, a second layer contains the side walls 4, which form a mesh stiffening the structure, and a third layer contains the screens 7 in the case of an embodiment without an intermediate space between the screens 7 and the second faces 2.

If the element E is essentially flat, a single layer may be sufficient. In this case, first faces 1 containing optical systems 5 are formed on a first face of this single layer, and second faces 2 are formed on a second face of this single layer.

The optical systems 5 are produced directly during the shaping of the elements E, or may be added later. The screens 7 are produced by grinding the second faces 2 or by depositing a coating on the second faces 2.

The principle of the invention allows great freedom of construction, and the shape of the element can be adapted considerably to match the requirements of the environment in which it is used. For example, sets of elements in the shape of truncated cones or pyramids can be used to form curved walls or domes. Sets of elements forming panels can be used to form shutters or doors.

The lighting function can be optimized, subject to a decrease in the possibility of seeing without being seen. The element according to the invention can be used to produce interesting lighting, using the external light, and the appearance of the element can be modified, by using colored glass for example.

It is also feasible to make all or part of the element according to the invention from a security glass having high mechanical strength, thus enabling the element to be used in environments having high security requirements, such as banks.

The invention claimed is:

1. A building element (E) for use in the construction of walls, partitions, paving, closing devices, shutters or doors, comprising:

at least one body (3), wherein the body is parallelepipedal, prismatic or cylindrical, limited by first (1) and second (2) parallel faces of transparent material and side walls (4), at least one optical system (5), having a focal plane, placed in a vicinity of the first face (1), and a translucent screen (7) positioned in such a way that an image of a space located in front of the optical system (5) is formed on said screen (7) and can be observed from a rear of said building element (E), wherein the first face (1) comprises a plurality of lenses, each causing formation of an image on the screen (7).

2. The building element as claimed in claim 1, wherein the screen (7) is located between the optical system (5) and the second face (2).

3. The building element as claimed in claim 1, wherein the screen (7) is placed on the second face (2).

4. The building element as claimed in claim 3, wherein the second face is transparent and its outer surface is ground.

5. The building element as claimed in claim 1, wherein the screen (7) is located in the vicinity of the focal plane of the optical system (5).

6. The building element as claimed in claim 1, wherein the optical system (5) has at least one lens (6).

7. The building element as claimed in claim 6, wherein the optical system (5) comprises at least one convex lens.

8. The building element as claimed in claim 1, wherein the side walls (4) have an opaque inner surface, at least in the space lying between the screen (7) and the second face (2).

9. The building element as claimed in claim 1, wherein the body of the element (E) is hollow.

10. The building element as claimed in claim 1, wherein the body of the element (E) is solid.

11. The building element as claimed in claim 1, wherein the optical system (5) occupies a whole of the first face (1).

12. The building element as claimed in claim 1, wherein the first face (1) and the optical system (5) are made in a single piece.

13. The building element as claimed in claim 1, wherein the body (3) has a geometrical axis and the optical system (5) has an optical axis parallel to or coinciding with the geometric axis of the body (3), and the screen (7) is perpendicular to the optical axis of the optical system (5).

14. The building element as claimed in claim 1, wherein the screen (7) comprises a translucent plate.

15. The building element as claimed in claim 1, wherein the building element has an intermediate space (8) between the screen (7) and the second face (2).

16. An assembly comprising a plurality of the elements as defined in claim 1.

17. The assembly as claimed in claim 16, wherein the assembly is produced by superimposition of a plurality of layers containing the different parts of the elements E.

18. A building element (E) for use in the construction of walls, partitions, paving, closing devices, shutters or doors, comprising:

at least one body (3), wherein the body is parallelepipedal, prismatic or cylindrical, limited by first (1) and second (2) parallel faces of transparent material and side walls (4), at least one optical system (5), having a focal plane, placed in a vicinity of the first face (1), and a translucent screen (7) positioned in such a way that an image of a space located in front of the optical system (5) is formed on said screen (7) and can be observed from a rear of said building element (E), wherein the side walls (4) are transparent and have an opaque outer surface, at least in the space lying between the screen (7) and the second face (2).

19. A building element (E) for use in the construction of walls, partitions, paving, closing devices, shutters or doors, comprising:

at least one body (3), wherein the body is parallelepipedal, prismatic or cylindrical, limited by first (1) and second (2) parallel faces of transparent material and side walls (4), at least one optical system (5), having a focal plane, placed in a vicinity of the first face (1), and a translucent screen (7) positioned in such a way that an image of a space located in front of the optical system (5) is formed on said screen (7) and can be observed from a rear of said building element (E), wherein the building element is molded in two parts, one comprising the first face (1) and the optical system (5) and the other part comprising the second face (2), the two parts being assembled one on each side of a plate acting as the screen (7).

* * * * *